US008228155B2

(12) United States Patent
Sarver et al.

(10) Patent No.: US 8,228,155 B2
(45) Date of Patent: Jul. 24, 2012

(54) MULTI-POINT CONNECTION MODULE FOR A TRANSFORMER COIL, AND A TRANSFORMER COMPRISING SUCH A CONNECTION MODULE

(75) Inventors: Charlie H Sarver, Rocky Gap, VA (US); Bobby Phil Goodson, Fries, VA (US); Joey Lee Chandler, Dublin, VA (US)

(73) Assignee: ABB Technology AG, Zurich (CH)

( * ) Notice: Subject to any disclaimer, the term of this patent is extended or adjusted under 35 U.S.C. 154(b) by 1010 days.

(21) Appl. No.: 11/601,297

(22) Filed: Nov. 17, 2006

(65) Prior Publication Data

US 2008/0136573 A1 Jun. 12, 2008

(51) Int. Cl.

| | |
|---|---|
| ***H01F 27/29*** | (2006.01) |
| ***H01F 27/04*** | (2006.01) |
| ***H01F 21/12*** | (2006.01) |
| ***H01F 27/30*** | (2006.01) |
| ***H01F 27/26*** | (2006.01) |

(52) U.S. Cl. ..... 336/192; 336/107; 336/150; 336/196; 336/197; 336/210

(58) Field of Classification Search ..... 336/192, 336/196–197, 210, 107, 150
See application file for complete search history.

(56) References Cited

U.S. PATENT DOCUMENTS

| | | | | |
|---|---|---|---|---|
| 2,942,073 | A * | 6/1960 | Barr | 200/4 |
| 3,399,364 | A * | 8/1968 | Barber | 336/107 |
| 3,728,656 | A * | 4/1973 | Neuber | 336/147 |
| 4,317,006 | A * | 2/1982 | Mosser, III | 178/46 |
| 5,161,088 | A | 11/1992 | Burgher | |
| 6,160,464 | A | 12/2000 | Clarke | |
| 6,223,421 | B1 | 5/2001 | Lanoue | |
| 6,676,454 | B2 * | 1/2004 | De France | 439/806 |

* cited by examiner

*Primary Examiner* — Elvin G Enad
*Assistant Examiner* — Tsz Chan
(74) *Attorney, Agent, or Firm* — Michael M. Rickin; Michael C. Prewitt

(57) ABSTRACT

A multi-point connection module comprising a supporting plate provided with a plurality of taps, and a connector which is coupled to the supporting plate. The connector allows the connection of the supporting plate to an external face of a transformer coil having a plurality of turns. The taps are arranged on the supporting plate so that they mate with corresponding turns of the coil.

21 Claims, 3 Drawing Sheets

MULTI-POINT CONNECTION MODULE FOR A TRANSFORMER COIL, AND A TRANSFORMER COMPRISING SUCH A CONNECTION MODULE

BACKGROUND OF THE INVENTION

The present invention relates to a multi-point connection module for a transformer coil, and to a transformer comprising such a multi-point connection module.

Power or distribution transformers are electrical devices used to transfer energy from one circuit to another. They utilize the principle of electromagnetic induction to step up or down a certain voltage level to a higher or lower voltage level. As it is known, electromagnetic induction induces a voltage on a conductor which is placed in a varying magnetic field. In transformers, the varying magnetic field is produced by applying an alternating current to a transformer coil, generally indicated as a primary coil or winding. This primary winding is normally coupled to a secondary winding or coil, and both primary and secondary windings, which comprise each a plurality of turns, are wound around a magnetic core. When the alternating current is applied to the primary winding, a varying magnetic flux is induced in the core and a voltage in the secondary coil is produced.

Besides unavoidable losses which are always present, the ratio of the voltages across the primary winding and the secondary winding is ideally equal to the ratio between the number of turns in the primary winding and in the secondary winding. Thus, by changing the ratio between the number of turns of the primary and the secondary windings, the ratio of the voltages can be changed. In this way, it is possible to control or regulate the voltage across the secondary winding which represents the output voltage supplied by the transformer, for example to any load connected therewith.

To this end, transformers are provided with specific connections which are referred to as taps in the transformer industry. The transformer taps are electrical connection points which are positioned along either the primary and/or the secondary windings and allow the number of turns to be selected. The selection of the tap to be used is made via a tap changer mechanism. For instance, the tap changer mechanism selects which turn in the secondary coil will be connected to a load circuit thereby varying the ratio of turns in the transformer and regulating the output voltage.

At present, for each coil there is provided a certain number of single connection taps, e.g. which are each attached to a corresponding turn in the coil and then are all brought out to the face of the coil. Usually, each tap is constituted by either a lug or a flat bar and in most cases the taps are welded inside the coil. Then, the taps are connected typically by a cable on the face of each coil.

This use of single connection taps as described above has some shortcomings, in particular as regard to the time required in the coil winding manufacturing process, to the content of material used, and also to the transformer enclosure depth size.

It would therefore be desirable to provide a solution which allows to optimize the manufacturing time in the coil winding process, to minimize the space needed inside the transformer enclosure, and to reduce the material costs associated with the transformers.

SUMMARY OF THE INVENTION

In accordance with the present invention, a multi-point connection module for a transformer coil having a plurality of insulated turns is provided. The multi-point connection module comprises:

a supporting plate provided with a plurality of taps, each of said taps allowing selection of a number of said plurality of transformer coil turns when said supporting plate is connected to said transformer coil, each of said taps comprising a first portion having at least one surface covered at least partially by sharp teeth which is meant to be connected to a corresponding turn of said plurality of transformer coil insulated turns without removing said insulation; and a non-conductive connector received at least partially into a through opening provided on said supporting plate, said non-conductive connector having a first end portion which protrudes outside said through opening and has a slot which is operatively coupled to and allows the connection of said supporting plate to and at an external face of said transformer coil at other than said transformer coil turns, wherein said taps are arranged on said supporting plate to mate with corresponding turns of said plurality of transformer coil turns when said supporting plate is connected by said non-conductive slot to other than said transformer coil turns. Also provided is a transformer comprising such a multi-point connection module.

Further, the present invention provides for a transformer comprising:

a coil having at least one winding comprising a plurality of insulated turns; and a connection module comprising a supporting plate provided with a plurality of taps, each of said taps allowing selection of a number of said plurality of transformer coil turns when said supporting plate is connected to said transformer coil and a non-conductive connector received at least partially into a through opening provided on said supporting plate, said non-conductive connector having a first end portion which protrudes beyond said through opening, wherein said first end portion and said supporting plate are coupled to and at an external face of said transformer coil at other than said transformer coil turns with said taps arranged thereon so that they are suitable to mate with corresponding turns of said plurality of transformer coil turns when said supporting plate is connected by said non-conductive first end portion to other than said transformer coil turns, each of said taps comprising a first portion having at least one surface covered at least partially by sharp teeth which is meant to be connected to a corresponding turn of said plurality of transformer coil insulated turns without removing said insulation.

A multi-point connection module for a transformer coil has a plurality of turns. The connection module includes but is not limited to a supporting plate provided with a plurality of taps; and a connector which is operatively coupled to and allows the connection of the supporting plate to and at an external face of the coil, wherein the taps are arranged on the supporting plate so that they are suitable to mate with corresponding turns of the plurality of turns; the connector including but is not limited to a shaped body having a substantially parallelepiped central portion which is inserted at least partially into a through opening provided on the supporting plate, a first end portion which protrudes outside the through opening and has a slot, and a second end portion which protrudes from the through opening opposite to the first end portion and extends transversally with respect to the substantially parallelepiped central portion.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
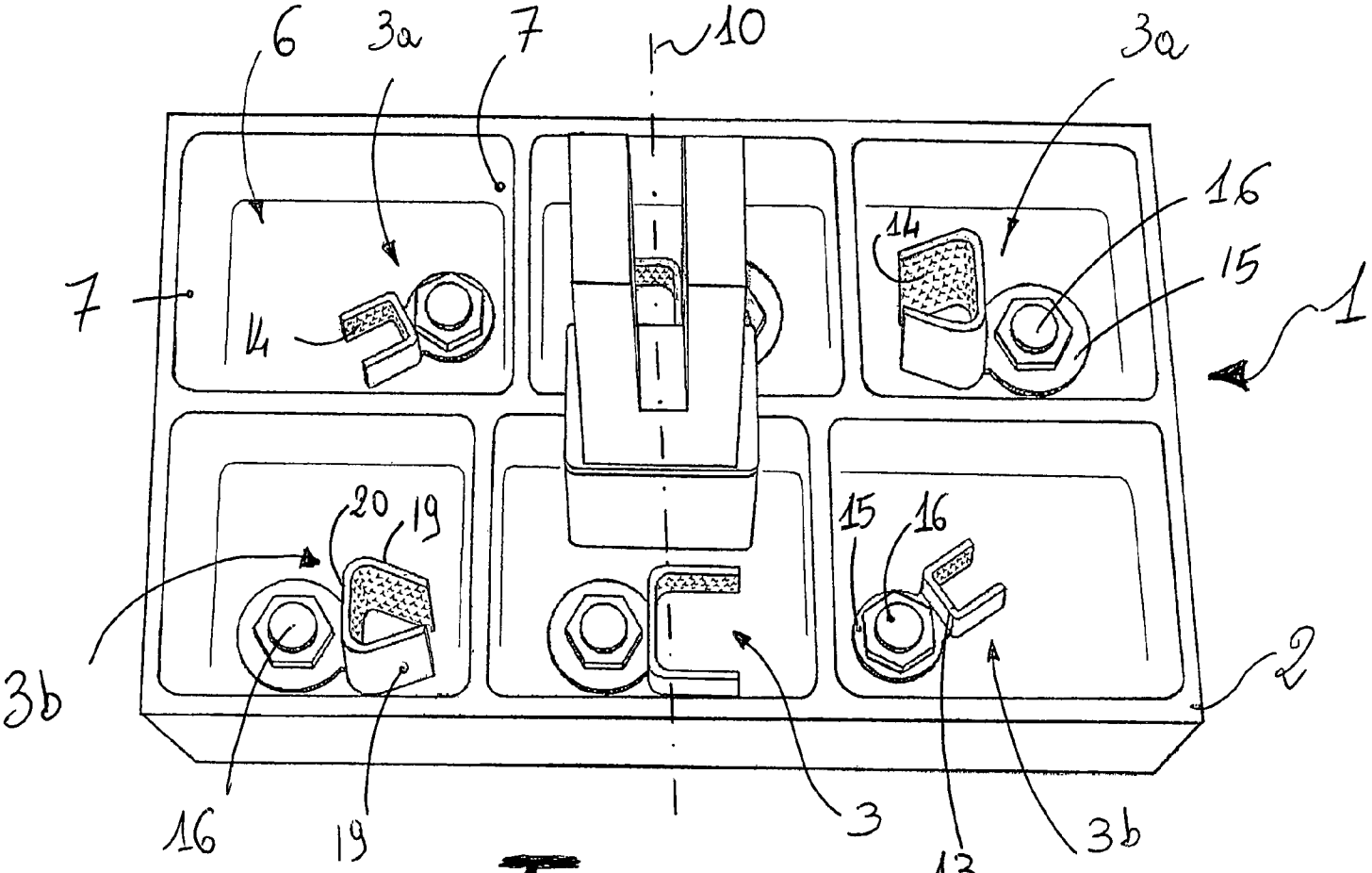
FIG. 1 is a perspective view showing a multi-point connection module according to the present invention.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Figure 3:
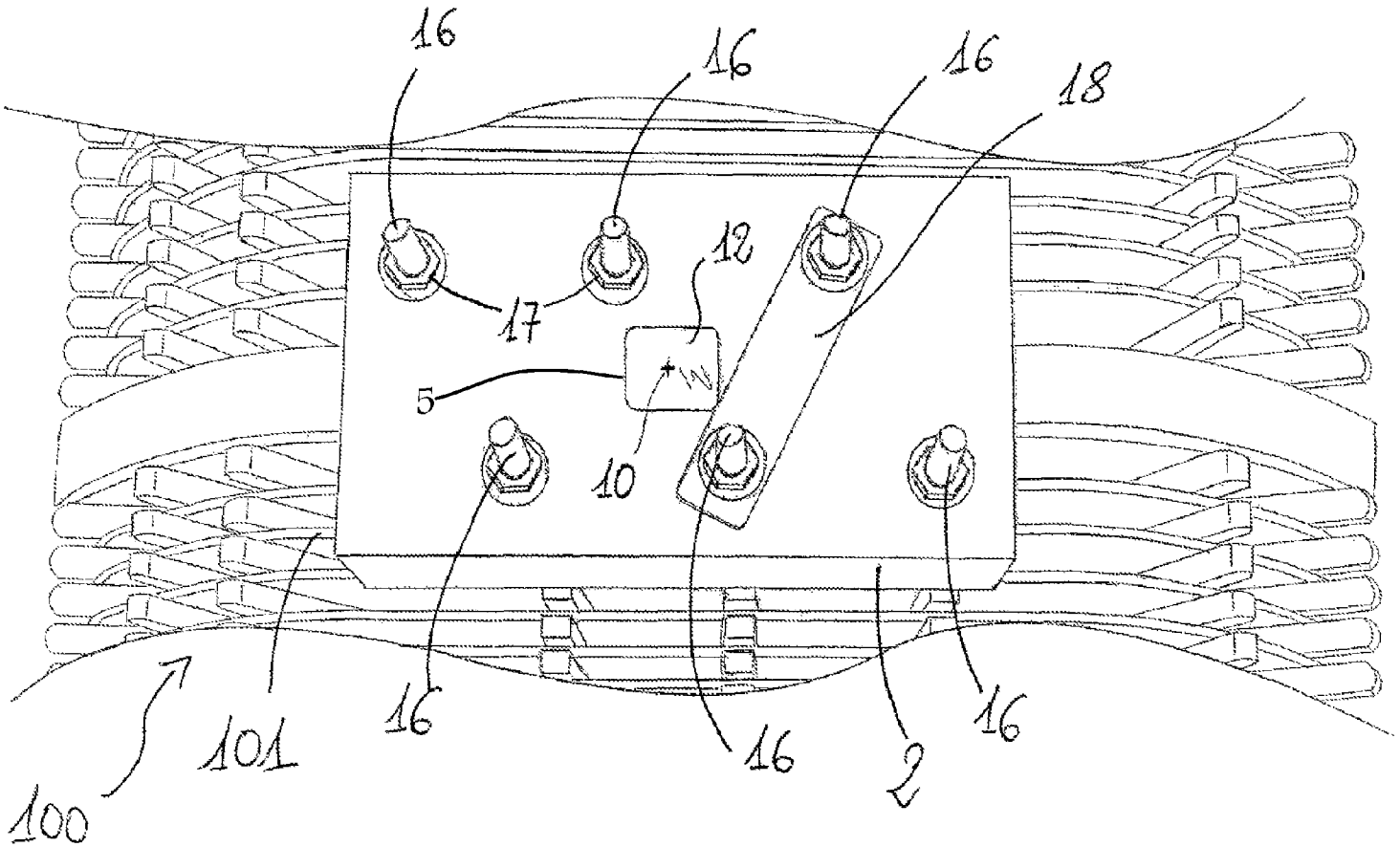
FIG. 3 is a perspective view of the multi-point connection module of FIG. I coupled to a transformer coil.

FIG. 1 illustrates a multi-point connection module according to the invention, globally indicated by the reference number 1 and seen from the mounting side, whereas FIG. 3 shows the connection module 1 seen from the opposite side and coupled with a transformer coil 100 having a plurality of turns 101. It should be noted that FIG. 3 shows a transformer coil 100 comprising windings of the so-called disc-wound type, and the present invention will be described hereinafter by making particular reference to such a type of coil windings, without intending in any way to limit any further possible application of the present invention to different types of coils. Further, the present invention should be understood as applicable to any suitable type of industrial transformers having one or more coils each comprising one or more windings formed by a plurality of windings. The construction, components, assembling, and functioning of transformers are well known in the art and readily available for any person having ordinary skill in the art, and thus a transformer is not illustrated here in further details, apart from the illustration of a transformer coil 100 and to the extent such an illustration is necessary for the understanding of the present invention.

As illustrated in FIG. 1, the multi-point connection module 1 according to the invention, which is shown from the mounting side, comprises a supporting plate 2 provided with a plurality of electrical taps 3, and a connector 4 which is operatively coupled to the supporting plate 2.

The supporting plate 2 comprises a shaped body, for example rectangular in the embodiment illustrated, which is made of plastic material. The plate 2 has a central through opening 5, suitable to receive the connector 4, and a plurality of compartments 6 having one or more lateral walls 7. The compartments 6 each house at least a portion of a corresponding tap 3. Further, the compartments 6 provide an additional surface area to reduce the electrical tracking or arcing and eliminate the possibility that parts of the taps 3 might enter into accidental contact with any other live connection in case of their rotation.

Figure 2:
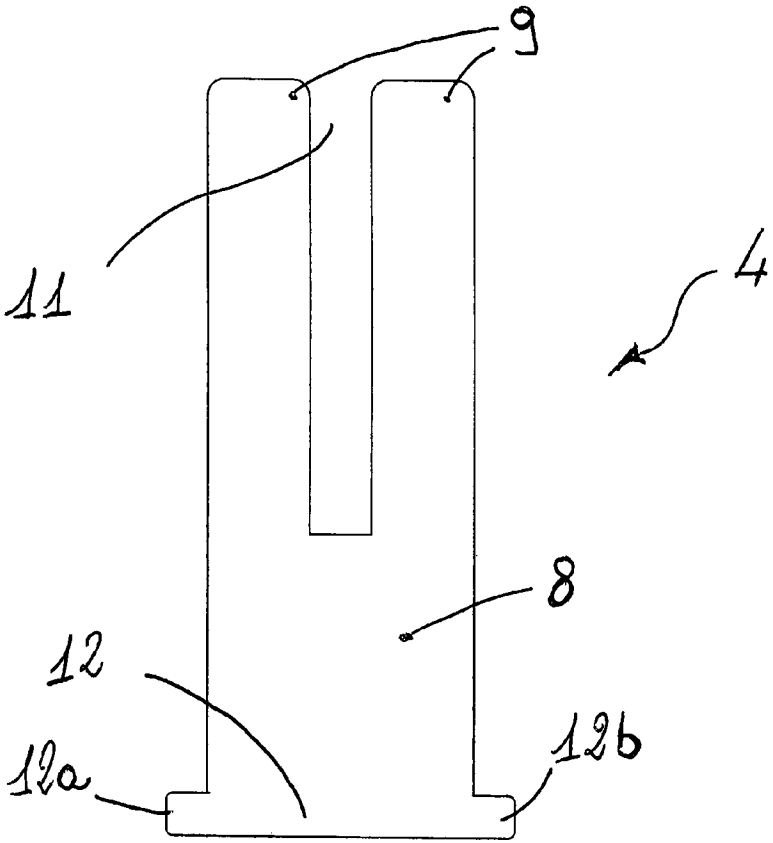
FIG. 2 is a plan view of a component of the multi-point connection module illustrated in FIG. 1.

In turn, the connector 4 allows the mechanical coupling of the supporting plate 2 to a coil, such as the coil 100 illustrated in FIG. 3, and at an external face of the coil itself in the way which will be described in more details hereinafter. In the embodiment illustrated in FIG. 2, the connector 4 comprises a single-piece body which is made for example of fiberglass material. The single-piece shaped body 4 has a substantially parallelepiped central portion 8 which is inserted at least partially into the through opening 5 provided on the supporting plate 2. Further, the shaped body 4 comprises a first end portion 9 which protrudes outside the through opening 5 and has a slot 11, and a second end portion 12 which protrudes from the through opening 5 opposite with respect to the first end portion 9. The second end portion 12 extends transversally with respect to the substantially parallelepiped central portion 8, so as when the single-piece shaped body is inserted into the through opening 5, its off-set portions 12*a*, 12*b* abut against the border of the opening 5 itself. In turn, the first end portion 9 locks into a component of the coil 100, e.g. a fiberglass spacer usually referred to as a spacer comb.

As illustrated in the figures, the taps 3 are arranged on the supporting plate 2, i.e. as regard either to their structure, and/or shape, and/or configuration, and/or positioning, and/or material composition, so that they are suitable to operatively mate with corresponding turns 101 of the plurality of turns 101, when the supporting plate 2 is being coupled to the coil 100.

Preferably, the taps 3 are arranged so as to be connected to corresponding turns 101 directly from the external face of the coil 100. As better illustrated in FIG. 3, in the module 1 according to the invention, at least a first tap 3*a* and a second tap 3*b* of the plurality of taps 3 are arranged on the supporting plate 2 substantially symmetrical to each other with respect to a reference axis 10 substantially perpendicular to the supporting plate 2 itself. More preferably, the taps 3 are placed on the supporting plate 2 substantially aligned along at least a first row and a second row and, with respect to the reference axis 10, each tap 3*a* of the taps aligned along the first row is positioned substantially symmetrical with a corresponding tap 3*b* placed along the second row. Further, the paired symmetrical taps are also substantially identical to each other.

In the embodiment illustrated in the figures, each tap 3 comprises a first portion 13 having at least one surface covered at least partially by sharp teeth 14 which is meant to be connected to a corresponding turn 101. As illustrated in FIG. 1, the first portion 13 comprises two lateral sides 19 connected by a central side 20, e.g. in a staple- or C-shaped configuration, wherein the lateral sides may be substantially parallel or converging to each other. Both the two lateral sides and also the central side are covered at least partially by teeth 14.

A tap 3 further comprises a second portion 15 which is washer-shaped and is preferably structurally integral with the first portion 13, and a third stud-shaped portion 16 which is operatively connected to the second washer-shaped portion 15. The portions 13, 15, and 16 are made each of an electrical conducting material, not necessarily the same for all three.

In practice, when the taps 3 are going to be assembled with the supporting plate 2, the integral piece formed by the two portions 13 and 15 is accommodated at least partially inside a corresponding compartment 6, while the stud-shaped portion 16 passes through the mounting wall of the supporting plate 2 and enters into the washer-shaped portion 15. Suitable nuts 17 are screwed onto the stud-shaped portion 16, thus putting into mutual electrical contact the two portions 15-16 and securing each whole tap 3 to the mounting wall of the supporting plate 2.

When coupling the assembled module 1 with the coil 100, the module 1 is operatively coupled to and at an external face of the coil 100 with the slot 11 of the end portion 9 of the connector which engages with a coil component, for example the coil spacer comb. The taps 3 mate with corresponding turns 101 and in particular the taps 3 are directly connected onto the corresponding turns 101 from the external face of the coil 100. Preferably, the taps 3 are clipped onto a corresponding turns 101 with the teeth 14 grasping the surface of the winding turns without necessarily removing the turn insulation.

The connection module I further comprises an electrical connecting element 18, e.g. a flat bar made of electrical conducting material, for electrically connecting to each other two taps 3, namely the respective stud-portions 16 as shown in FIG. 3. Thanks to the above described symmetrical positioning of the taps, and in particular of the stud-shaped portions 16, the connecting element 18 allows to connect the taps 3 in a specific order thus determining the number of turns 101 connected and therefore the output voltage generated by the transformer. In this way, all necessary connections are located at the faces of the supporting plate 2.

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims. For example, the supporting plate may be shaped in a different way, the connector 4 may be differently shaped or may be realized in two or more pieces. The number of taps can be varied according to the applications. Each of the taps may be realized in a different number of portions, or the shape of one or more of the portions may be modified provided they remains suitable for the function they are required to perform.

What is claimed is:

1. A multi-point connection module for a transformer coil having a plurality of insulated turns, the connection module comprising:

a supporting plate provided with a plurality of taps, each of said taps allowing selection of a number of said plurality of transformer coil turns when said supporting plate is connected to said transformer coil, each of said taps comprising a first portion having at least one surface covered at least partially by sharp teeth which is meant to be connected to a corresponding turn of said plurality of transformer coil insulated turns without removing said insulation; and a non-conductive connector received at least partially into a through opening provided on said supporting plate, said connector having a first end portion which protrudes outside said through opening and has a slot which is operatively coupled to and allows the connection of said supporting plate to and at an external face of said transformer coil at other than said transformer coil turns, wherein said taps are arranged on said supporting plate to mate with corresponding turns of said plurality of transformer coil turns when said supporting plate is connected by said non-conductive connector slot to other than said transformer coil turns.

2. The multi-point connection module of claim 1, wherein said taps are arranged so as to be connected to said corresponding turns directly on said external face of the transformer coil.

3. The multi-point connection module of claim 1 wherein at least a first tap and a second tap of said plurality of taps are arranged on said supporting plate substantially symmetrical to each other with respect to a reference axis substantially perpendicular to the supporting plate.

4. The multi-point connection module of claim 1, wherein said taps are placed on said supporting plate aligned along at least a first row and a second row, each of the taps aligned along said first row being positioned substantially symmetrical with a corresponding tap placed along said second row with respect to a reference axis substantially perpendicular to the supporting plate.

5. The multi-point connection module of claim 1, wherein said supporting plate comprises a plurality of compartments each housing at least a portion of a corresponding tap, said compartments having at least one lateral wall for separating said taps from each other.

6. The multi-point connection module of claim 1 wherein said connection module comprises a connecting element for connecting to each other two taps of said plurality of taps.

7. The multi-point connection module of claim 1, wherein said non-conductive connector comprises a shaped body having a substantially parallelepiped central portion which is inserted at least partially into said a through opening provided on said supporting plate, and a second end portion which protrudes from said through opening opposite to the first end portion and extends transversally with respect to said substantially parallelepiped central portion.

8. The multi-point connection module of claim 1, wherein said taps further comprise a second washer-shaped portion which is structurally integral with said first portion, and a third stud-shaped portion which is operatively connected to said second washer-shaped portion and passes through said supporting plate.

9. A transformer comprising:

a coil having at least one winding comprising a plurality of insulated turns; and a connection module comprising a supporting plate provided with a plurality of taps, each of said taps allowing selection of a number of said plurality of transformer coil turns when said supporting plate is connected to said transformer coil and a non-conductive connector received at least partially into a through opening provided on said supporting plate, said non-conductive connector having a first end portion which protrudes beyond said through opening wherein said first end portion and said supporting plate are coupled to and at an external face of said transformer coil at other than said transformer coil turns with said taps arranged thereon so that they are suitable to mate with corresponding turns of said plurality of transformer coil turns when said supporting plate is connected by said non-conductive first end portion to other than said transformer coil turns, each of said taps comprising a first portion having at least one surface covered at least partially by sharp teeth which is meant to be connected to a corresponding turn of said plurality of transformer coil insulated turns without removing said insulation.

10. The transformer of claim 9, wherein said taps are arranged so as to be directly connected to said corresponding turns on said external face of the transformer coil.

11. The transformer of claim 10, wherein at least one of said taps is clipped on a corresponding turn.

12. The transformer of claim 9 wherein at least a first tap and a corresponding second tap of said plurality of taps are arranged on said supporting plate substantially symmetrical to each other with respect to a reference axis substantially perpendicular to the supporting plate.

13. The transformer of claim 9 wherein said taps are placed on said supporting plate aligned along at least a first row and a second row, respectively.

14. The transformer of claim 9 wherein each of the taps aligned along said first row is positioned substantially symmetrical with a corresponding tap placed along said second row with respect to a reference axis substantially perpendicular to the supporting plate.

15. The transformer of claim 9 wherein said supporting plate comprises a plurality of compartments each receiving at least a portion of a corresponding tap.

16. The transformer of claim 9 wherein said connection module comprises a connecting element for connecting to each other two taps of said plurality of taps.

17. The transformer of claim 9 wherein said non-conductive connector comprises a shaped body having a substantially parallelepiped central portion which is inserted at least partially into the through opening provided on said supporting plate, said first end portion has a slot, and said non-conductive connector further including a second end portion which protrudes from said through opening opposite to the first end portion and extends transversally with respect to said substantially parallelepiped central portion.

18. The transformer of claim 9 wherein said taps further comprise a second washer-shaped portion which is structurally integral with said first portion, and a third stud-shaped portion which is operatively connected to said second washer-shaped portion and passes through said supporting plate.

19. A transformer comprising a multi-point connection module as in claim 1.

20. A multi-point connection module for a transformer coil having a plurality of turns, the connection module comprising:

a supporting plate provided with a plurality of taps; and a connector which is operatively coupled to and allows the connection of said supporting plate to and at an external face of said coil, wherein said taps are arranged on said supporting plate so that they are suitable to mate with corresponding turns of said plurality of turns; said connector comprising a shaped body having a substantially parallelepiped central portion which is inserted at least partially into a through opening provided on said supporting plate, a first end portion which protrudes outside said through opening and has a slot, and a second end portion which protrudes from said through opening opposite to the first end portion and extends transversally with respect to said substantially parallelepiped central portion.

21. A transformer comprising a multi-point connection module as in claim 20.

* * * * *

UNITED STATES PATENT AND TRADEMARK OFFICE

CERTIFICATE OF CORRECTION

PATENT NO. : 8,228,155 B2
APPLICATION NO. : 11/601297
DATED : July 24, 2012
INVENTOR(S) : Sarver et al.

It is certified that error appears in the above-identified patent and that said Letters Patent is hereby corrected as shown below:

In the Claims

Column 6, Claim 14, line 66, "9" should read --13--.

Signed and Sealed this
Sixth Day of May, 2014

Michelle K. Lee

Michelle K. Lee
*Deputy Director of the United States Patent and Trademark Office*